United States Patent [19]

Swenson

[11] 3,939,922

[45] Feb. 24, 1976

[54] HYDRAULIC HAMMER ASSEMBLY

[75] Inventor: William J. Swenson, Houston, Tex.

[73] Assignee: Raymond International, Inc., Houston, Tex.

[22] Filed: Nov. 13, 1974

[21] Appl. No.: 523,527

[52] U.S. Cl. ..... 173/125; 91/216 B; 92/117 A; 173/126

[51] Int. Cl.[2] ..... E02D 7/10

[58] Field of Search ..... 173/125, 134–138; 91/216 B, 216 R; 92/117 A

[56] References Cited

UNITED STATES PATENTS

| | | | |
|---|---|---|---|
| 1,077,469 | 11/1913 | Goubert | 91/216 B |
| 2,068,045 | 1/1937 | Wohlmeyer | 173/125 X |
| 3,216,327 | 11/1965 | Johannsson | 91/216 R |
| 3,431,986 | 3/1969 | Jansz | 173/134 |
| 3,511,130 | 5/1970 | Fishburne | 91/216 R |

*Primary Examiner*—Ernest R. Purser
*Attorney, Agent, or Firm*—Fitzpatrick, Cella, Harper & Scinto

[57] ABSTRACT

A hydraulic hammer assembly is disclosed which comprises a stationary piston suspended within a tubular frame or casing and a cylinder locked inside a massive ram within the casing. The cylinder forms a differential hydraulic assembly with the piston and moves up and down along the piston. The cylinder is maintained locked to the ram by the pressure of the hydraulic fluid; and the piston, which is formed of two members, is held in assembly by a continuous hydraulic bias with a special hydraulic balancing arrangement which compensates for the pressure switching in the cylinder to which one portion of the piston assembly is exposed.

31 Claims, 15 Drawing Figures

Fig. 10.
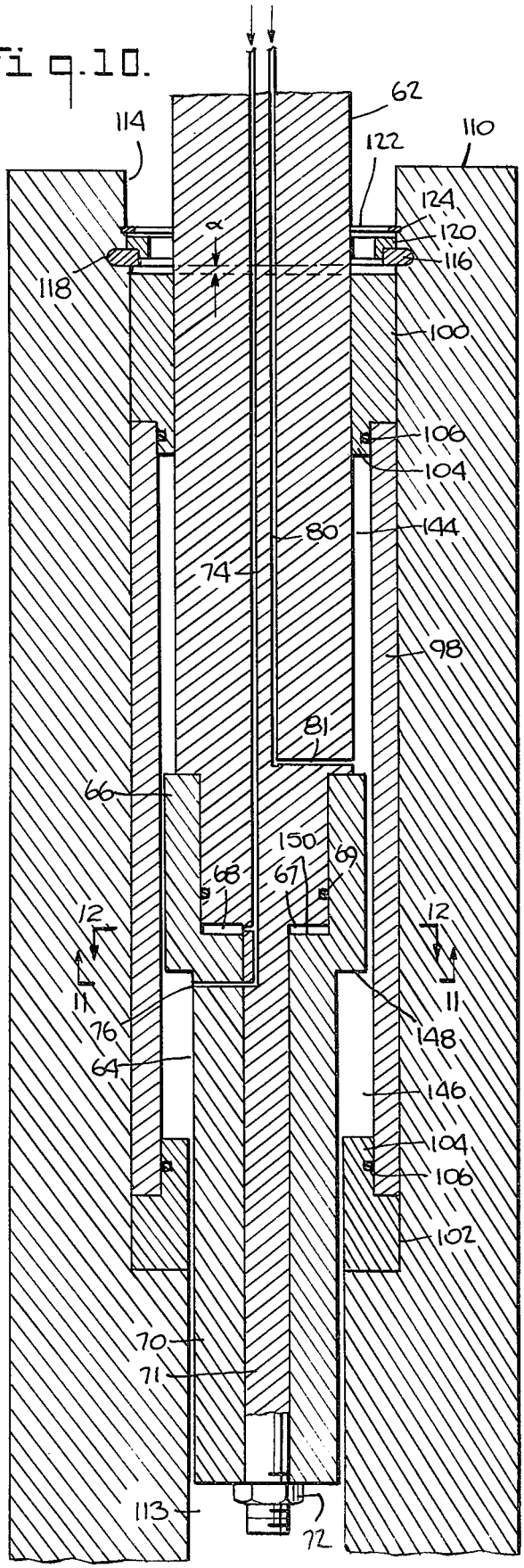
Fig. 11.
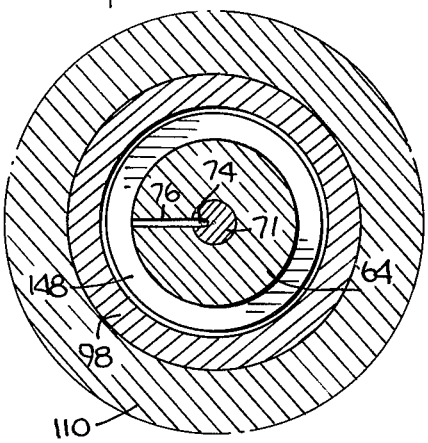
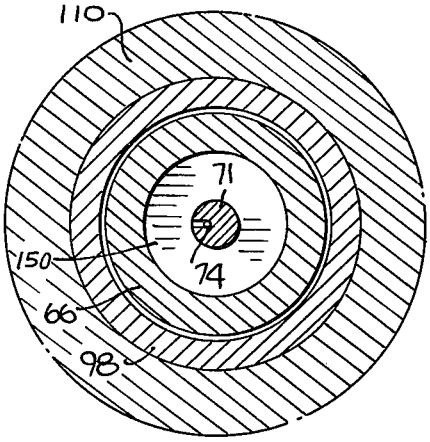
Fig. 12.
Fig. 13.
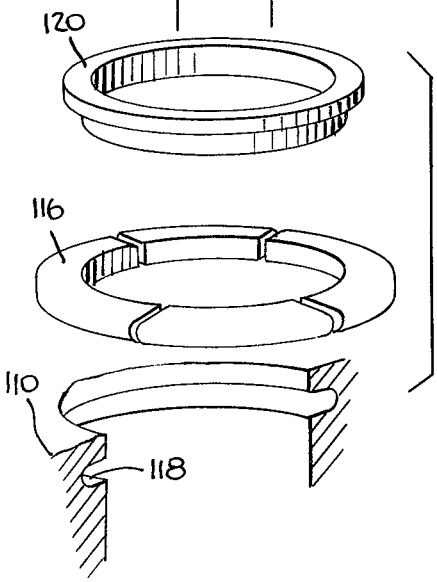

HYDRAULIC HAMMER ASSEMBLY

BACKGROUND OF THE INVENTION

1. Field of the Invention

This invention relates to driving systems and more particularly it concerns novel hydraulic hammers for driving piles and similar elements.

2. Description of the Prior Art

Hydraulically driven hammers are described in copending U.S. application Ser. No. 391,569 filed Aug. 27, 1973 and in U.S. Pats. Nos. 3,283,832, 3,298,447, 3,431,986. In each of these prior disclosures a piston, which is connected to or forms part of a ram, moves along inside a stationary cylinder. U.S. Pat. No. 3,298,447 also discloses a differential type actuating piston and cylinder assembly wherein a smaller diametrical, or working area region on one side of a piston is continuously supplied with hydraulic fluid at high pressure while the opposite side of the piston, which is of larger diametrical or working area is alternately switched between high and low pressure.

In U.S. Pat. No. 3,417,828 there is described a hydraulically driven hammer wherein a cylinder incorporated into a moveable ram is driven up and down along a stationary piston. This last mentioned patent, however, provides no disclosure of differential hydraulic driving. A similar arrangement, using steam, is disclosed in U.S. Pat. No. 1,158,839.

SUMMARY OF THE INVENTION

According to one aspect of the present invention there is provided a differential type hydraulic hammer system which comprises a casing, a central piston secured at one end to the casing, a cylinder surrounding and slideable along the piston, a massive ram containing and carried by the cylinder, and an anvil mounted in the casing in the path of ram movement to be hammered on by the ram. The piston extends through and slides along both ends of the cylinder; and it has a central large cross section region which divides the interior of the cylinder into different hydraulic chambers. The piston cross section is different on the opposite sides of its large cross section region so that the two chambers have different diametrical or working areas. High hydraulic pressure is supplied continuously to the chamber of small working area while the other chamber is switched alternately between high and low hydraulic pressure.

By incorporating the cylinder into the moving ram, high pressure may be utilized without danger of outward bowing of the cylinder. Also, by providing piston portions which extend through both ends of the cylinder it is possible to obtain a reasonable differential area effect with a piston of sufficient diameter to provide strength and space for hydraulic conduits. Although it is theoretically possible to utilize a differential area effect in a piston which does not pass through both ends of a cylinder, such an arrangement is not practical for use with high pressures (e.g., in the order of 2000 pounds per square inch or higher) because in the case where the piston terminates inside the cylinder, the resulting driving forces would require an excessively heavy overall hammer structure. The only way to reduce this differential, outside the present invention, is to reduce the size of the piston rod; however, this would weaken the structure and would not allow sufficient room for hydraulic flow lines through the piston.

According to a further aspect of the invention there is provided a hydraulic hammer assembly with a cylinder structure capable of automatically locking itself to a massive ram which it drives, such locking being produced by the pressure of the driving fluid. This cylinder structure has elemental portions which are moveable into tight contact with the ram upon application of high hydraulic pressure to the interior of the cylinder. In a preferred embodiment the cylinder has a tubular sleeve which fits into a bore in the ram. The sleeve is closed at both ends and at least one end is longitudinally moveable by a finite amount. A stop element is fitted into a recess in the ram bore after the cylinder is in place and when the cylinder is subjected to operating pressure its end expands against the stop element to lock it in place.

In another of its different aspects the present invention provides a hydraulic hammer assembly wherein a piston and cylinder assembly is made up of several elements and is fitted to a reciprocal ram in a frame or casing. The various elements are laterally moveable with respect to each other by a finite amount; and they automatically become aligned when subjected to operating hydraulic pressure.

According to a still further aspect of the invention there is provided a piston assembly comprising first and second members extending into a differential cylinder with one of the members being exposed on one side to a first cylinder chamber maintained continuously at high pressure and exposed on the other side to a second cylinder chamber which is switched alternately between high and low pressures. A continuous longitudinal bias is maintained between the two members so that they may be held together even though one side of one of the members is exposed to different pressures. This continuous bias is obtained by forming a balancing chamber between the two members and maintaining this balancing chamber in fluid communication with the second cylinder chamber. The one member is formed with a diametrical or working surface in the balancing chamber which is equal in area but opposite to the diametrical or working surface thereof exposed to the second chamber. Thus as the pressure in the second chamber is switched a balancing effect is produced on the one piston member through the balancing chamber so that the continuous force produced on that member by the continuous high pressure in the first chamber is maintained.

There has thus been outlined rather broadly the more important features of the invention in order that the detailed description thereof that follows may be better understood, and in order that the present contribution to the art may be better appreciated. There are, of course, additional features of the invention that will be described hereinafter and which will form the subject of the claims appended hereto. Those skilled in the art will appreciate that the conception upon which this disclosure is based may readily be utilized as a basis for the designing of other structures or methods for carrying out the several purposes of the invention. It is important, therefore, that the claims be regarded as including such equivalent constructions and methods as do not depart from the spirit and scope of the invention.

BRIEF DESCRIPTION OF THE DRAWINGS

A specific embodiment of the invention has been chosen for purposes of illustration and is shown in the accompanying drawings, forming a part of the specification, wherein:

FIG. 10 is a stylized elevational section view representing a piston cylinder and ram assembly forming a portion of the hammer of FIG. 1;

FIGS. 11 and 12 are cross section views taken along lines 11—11 and 12—12, respectively of FIG. 10; and FIG. 13 is an exploded perspective view illustrating a cylinder to ram retaining assembly used in the hammer of FIG. 1.

DESCRIPTION OF THE PREFERRED EMBODIMENTS

Figure 1:
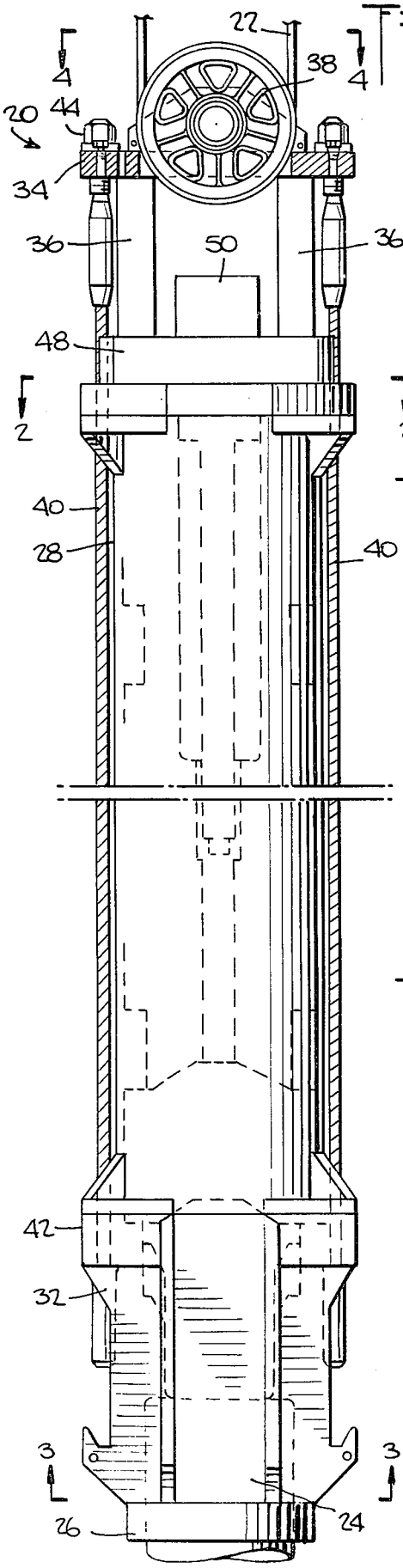
FIG. 1 is an elevational view, partially cut away, of a hydraulically driven pile driving hammer assembly in which the present invention is embodied.
Figure 4:
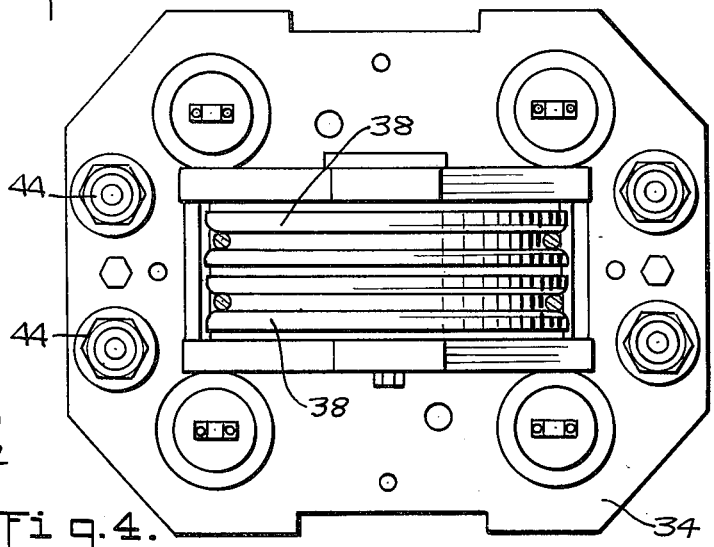
FIGS. 2, 3 and 4 are views taken along lines 2—2, 3—3 and 4—4 of FIG. 1 respectively.

As shown in FIGS. 1–4, a hammer assembly 20, in which the present invention is embodied, is suspended by means of a lift cable 22 above a capblock 24 which rests on a pile 26. The external construction of the hammer assembly 20 includes an elongated tubular casing 28 (FIG. 1) which is outwardly flanged at its upper and lower ends, and a casing top section 30 (FIG. 2) and a bottom section 32 (FIG. 3) which rest upon the flanged upper and lower ends, respectively, of the casing. A sheave plate 34 (FIG. 4) is maintained a predetermined distance above the casing top by means of spacer elements 36. Sheaves 38 are journalled on the sheave plate 34 as shown in FIGS. 1 and 4; and the lift cable 22 passes around the sheaves and up to corresponding sheaves on a hammer support rig (not shown).

The tubular casing 28, the top section 30, the bottom section 32 and the sheave plate 34 are held together by means of a plurality of column cables 40 which extend along the outside of the hammer assembly 20 from flanges 42 on the bottom section 32 (FIG. 3) to threaded fasteners 44 above the sheave plate 34.

A hydraulic manifold 48 is incorporated into the casing top section 30. This manifold communicates between a valve assembly 50 located thereon and various internal elements (to be described hereinafter) within the tubular casing 28.

Figure 3:
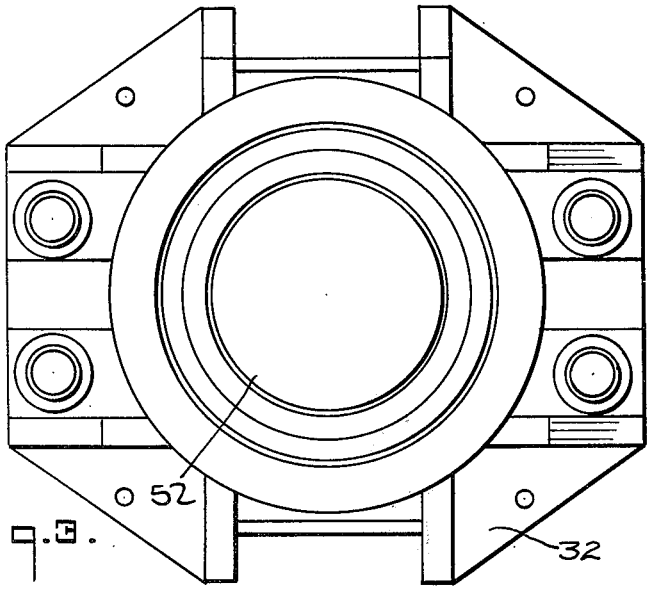

As shown in FIG. 3 the bottom section 32 has a central opening therein which is occupied by an anvil 52. During operation of the hammer this anvil, which rests on the capblock 24, is hammered by ram means within the casing; and the anvil transmits the hammer blows to the capblock for driving of the pile.

Figure 2:
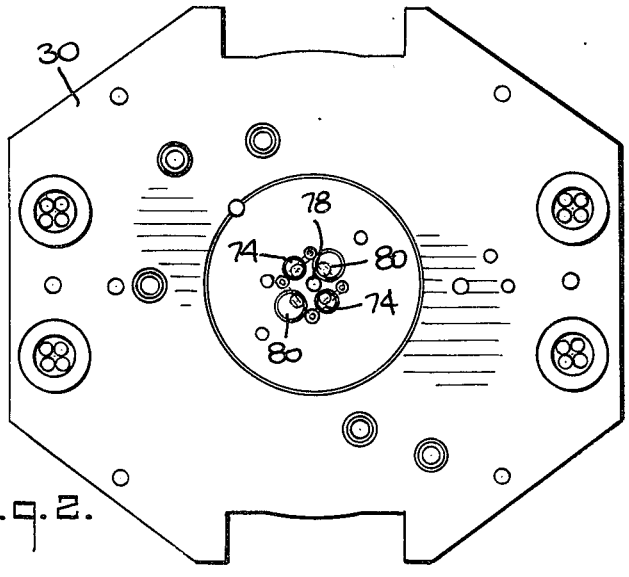
Figure 5A:
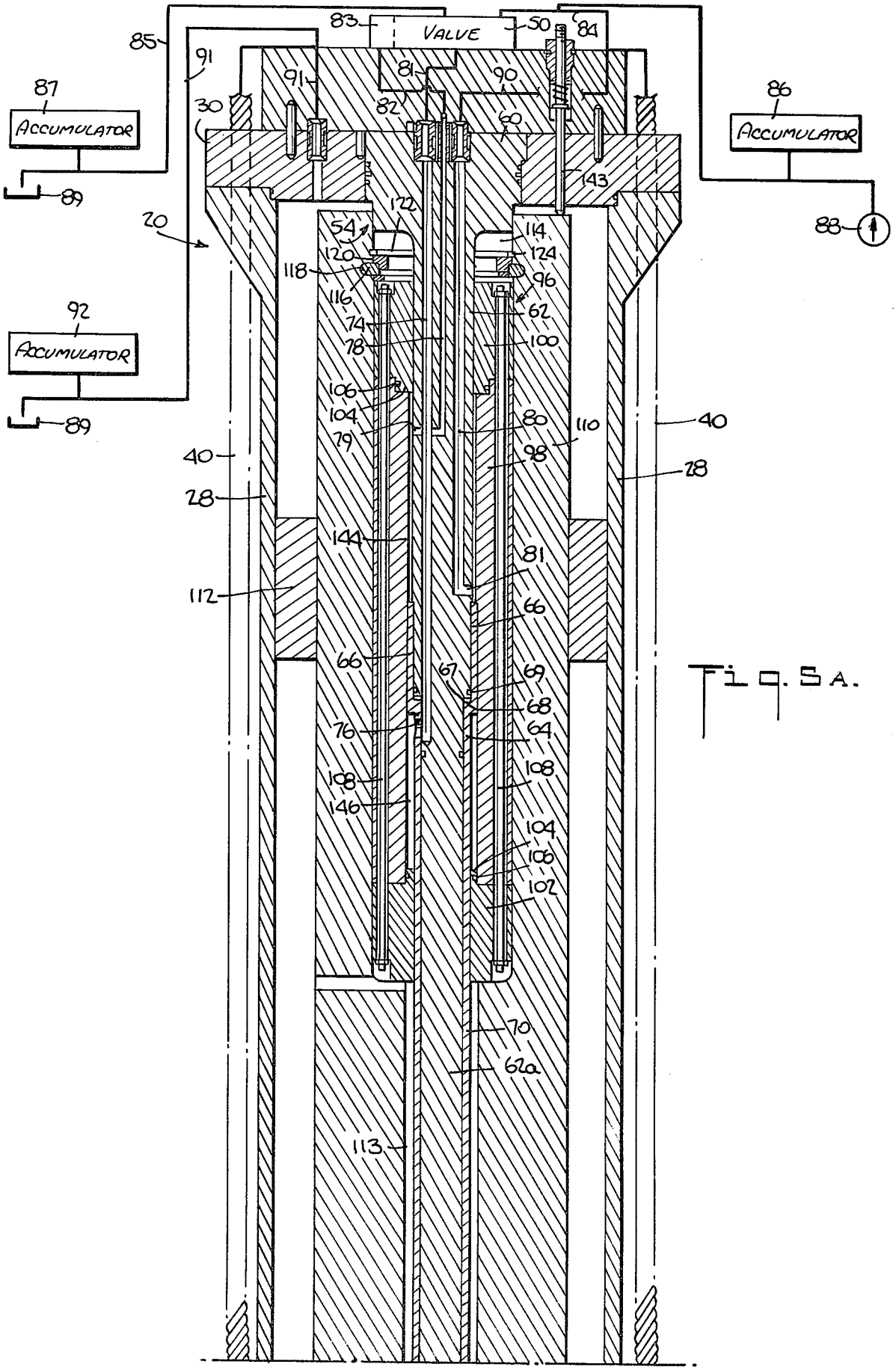
FIG. 5A is an enlarged elevational section view showing the interior of the upper portion of the hammer assembly of FIG. 1 at one stage of its operating cycle.
Figure 5B:
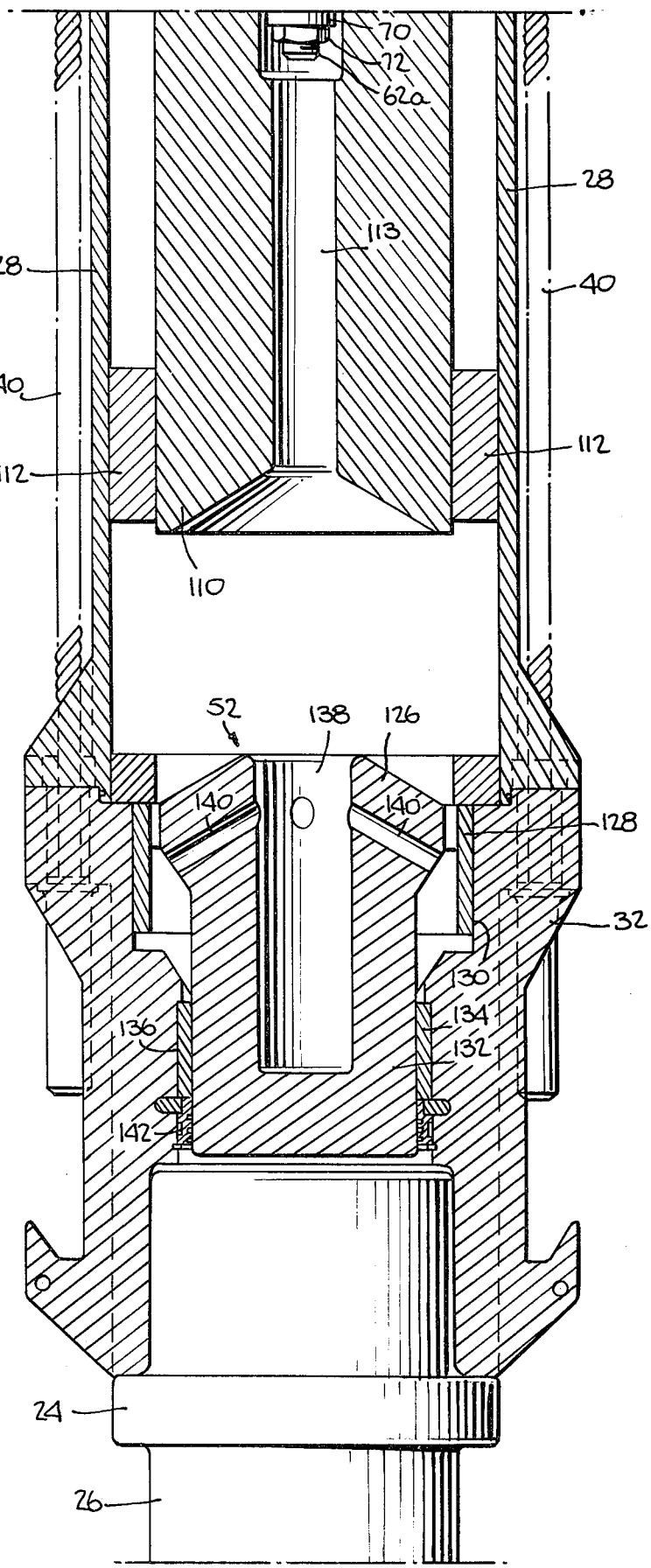
FIG. 5B is an enlarged elevational section view showing the interior of the lower position of the hammer assembly of FIG. 1, at said one stage of its operating cycle.

FIGS. 5A and 5B together show the internal construction of the hammer assembly 20 as it appears when the internal ram means thereof is in its uppermost position. A stationary piston rod assembly 54 extends axially down inside the tubular casing 28. The piston rod assembly includes an upper enlarged head portion 60 which extends through and is sealed to the casing top section 30 (FIGS. 2 and 5A). An intermediate diameter upper portion 62 extends down from the head portion 60. A tubular lower piston rod portion 64 surrounds a lower extension **62*a* of the upper portion 62. This tubular lower portion includes at its upper end a large diameter cup shaped formation 66 which telescopes over a step 67 in the upper portion 62. The step 67 is somewhat higher than the bottom of the interior of the cup shaped formation; so that there is formed below the step an annular balancing chamber 68. An O-ring seal 69 is provided between the upper piston rod portion and the interior of the cup shaped formation 66 just above the balancing chamber. The tubular lower piston rod portion 64 also includes an elongated tubular small diameter section 70 which extends down from the large diameter cup shaped formation 66 and fits closely around the small diameter lower extension 62*a* of the upper portion 62. As shown in FIG. 5B the lower extension 62*a*, which is integral with the upper portion 62, extends down beyond the bottom of the tubular small diameter section 70; and it is threaded at its lower end. A retaining nut 72 is threaded onto the lower extension 62*a* and abuts the bottom of the small diameter section 70 to hold the tubular piston rod portion 64 to the upper portion 62**.

The upper portion 62 of the piston rod assembly is longitudinally bored to provide hydraulic conduits for actuation of the hammer assembly. As shown in FIGS. 2 and 5A there are provided a pair of actuation conduits 74 which extend down from the head portion 60 and which open laterally as their lower ends through actuation ports 76 to the exterior of the lower portion 64 just below the cup shaped formation 66. The conduits 74 also open into the balancing chamber 68. An axial pilot conduit 78 also extends down from the head portion 60 and opens laterally through a pilot opening 79 onto the surface of the intermediate diameter upper portion 62. A pair of upper chamber supply conduits 80 extend down from the head portion 60; and these open laterally at their lower ends through actuation ports 81 just above the cup shaped formation 66.

As shown diagramatically in FIG. 5A, the hydraulic manifold 48 is formed with an internal conduit 81 which connects the actuation conduits 74 to the output of the valve assembly 50. A pilot connection conduit 82 in the manifold 48 connects the pilot conduit 78 to a pilot stage 83 of the valve assembly 50. The inputs to the valve assembly 50 include a high pressure input 84 and a low pressure input 85 connected, respectively, to high and low pressure accumulators 86 and 87 mounted between the manifold 48 and the sheave plate 34. These accumulators are connected in turn to a pump 88 and to a drain or reservoir 89.

The manifold 48 is also formed with a high pressure conduit 90 which interconnects the high pressure accumulator 86 with the upper chamber supply conduits 80. Also, a low pressure conduit 91 is provided in the manifold 48; and this interconnects a further low pressure accumulator 92 with the interior of the casing 28.

A preferred form of the valve assembly 50 and arrangements for interconnecting same to a hydraulic system, including a differential type hammer, is shown and described in U.S. Patent application Ser. No. 507,425 filed 9/19/74 in the name of Peter B. Olmstead. As therein described, the valve assembly operates to switch the actuation conduits 74 between high and drain pressure in response to pressure impulses detected by the pilot conduit 78, as a ram being controlled moves up and down.

A moveable hydraulic cylinder assembly 96 is formed about the stationary piston rod assembly 54. This cylinder assembly comprises a tubular sleeve 98 with upper and lower end collars 100 and 102. The tubular sleeve 98 has an inner diameter corresponding to the diameter of the cup shaped formation 66 of the piston rod assembly 54; and it slides closely over this cup shaped portion. The upper end collar 100 fits closely over and slides along the intermediate diameter upper portion 62 of the piston assembly; and the lower end collar 102 fits closely over and slides along the small diameter section 70 of the piston assembly. The upper and lower end collars 100 and 102 have extensions 104 which fit closely inside the sleeve 98; and O-ring seals 106 are provided between these extensions and the inner surface of the sleeve. The sleeve 98 and collars 100 and 102 are longitudinally bored at various locations about their circumference; and tie rods 108 extend through these bores to hold the collars and sleeve together. As will be explained more fully hereinafter these tie rods do not hold the end collars tightly to the sleeve but instead they merely loosely hold the assembly together during assembly so that the entire assembly may be hydraulically locked together during operation.

A massive tubular ram 110 is provided inside the outer tubular casing 28. This ram is guided by means of spaced apart bushings 112 to move longitudinally within the casing. As shown in FIG. 5B, the lower end of the ram 110 is formed to conform to the configuration of the upper end of the anvil 52 so that when the ram moves downwardly within the casing it will strike the anvil sharply for efficient driving.

The ram 110 is formed with a main bore 113 which extends throughout its length; and a counterbore 114 at its upper end. This counterbore is of sufficient diameter to allow the hydraulic cylinder assembly 96 to fit down into it. A segmented retention member 116 fits into a groove 118 formed in the ram counterbore 114 just above the upper collar 102 of the cylinder assembly. The retention member extends past way into the counterbore 114 so that it overlies the upper collar 100 of the cylinder assembly to hold the ram 110 locked to the cylinder assembly. A spreader ring 120 fits inside the retention member 116 to keep it spread into the groove 118; and a spring-like snap ring 122 is fitted into an upper groove 124 formed in the ram counterbore 114 just above the groove 118 to hold the spreader ring 120 in place.

As shown in FIG. 5B the anvil 52 has a large diameter head 126 which slides up and down in an upper sleeve bushing 128 located in a counterbore 130 of the bottom section 32. A stem 132 projects down from the head 126 of the anvil and is guided by a lower sleeve bushing 134 in a central bore 136 of the bottom section. A central oil passage 138 and radially extending passages 140 are formed in the anvil 52 to connect the region under its large diameter head 126 with the region thereabove to prevent fluid entrapment which would otherwise resist movement of the anvil. An oil seal 142 is provided around the anvil stem 132 below the lower sleeve bushing 134 to prevent or minimize leakage from within the tubular casing while allowing the anvil to move up and down under the influence of hammer blows.

During operation of the hammer assembly the casing 28, including the region around and under the anvil head 126 is filled with hydraulic fluid which is maintained at drain or low pressure by the connection 91 to the low pressure accumulator 87. As the ram 110 moves up and down in the casing to hammer on the anvil 52, the oil in the casing becomes displaced around the outer surfaces of the ram and between the spaced apart bushings 112.

Figure 6A:
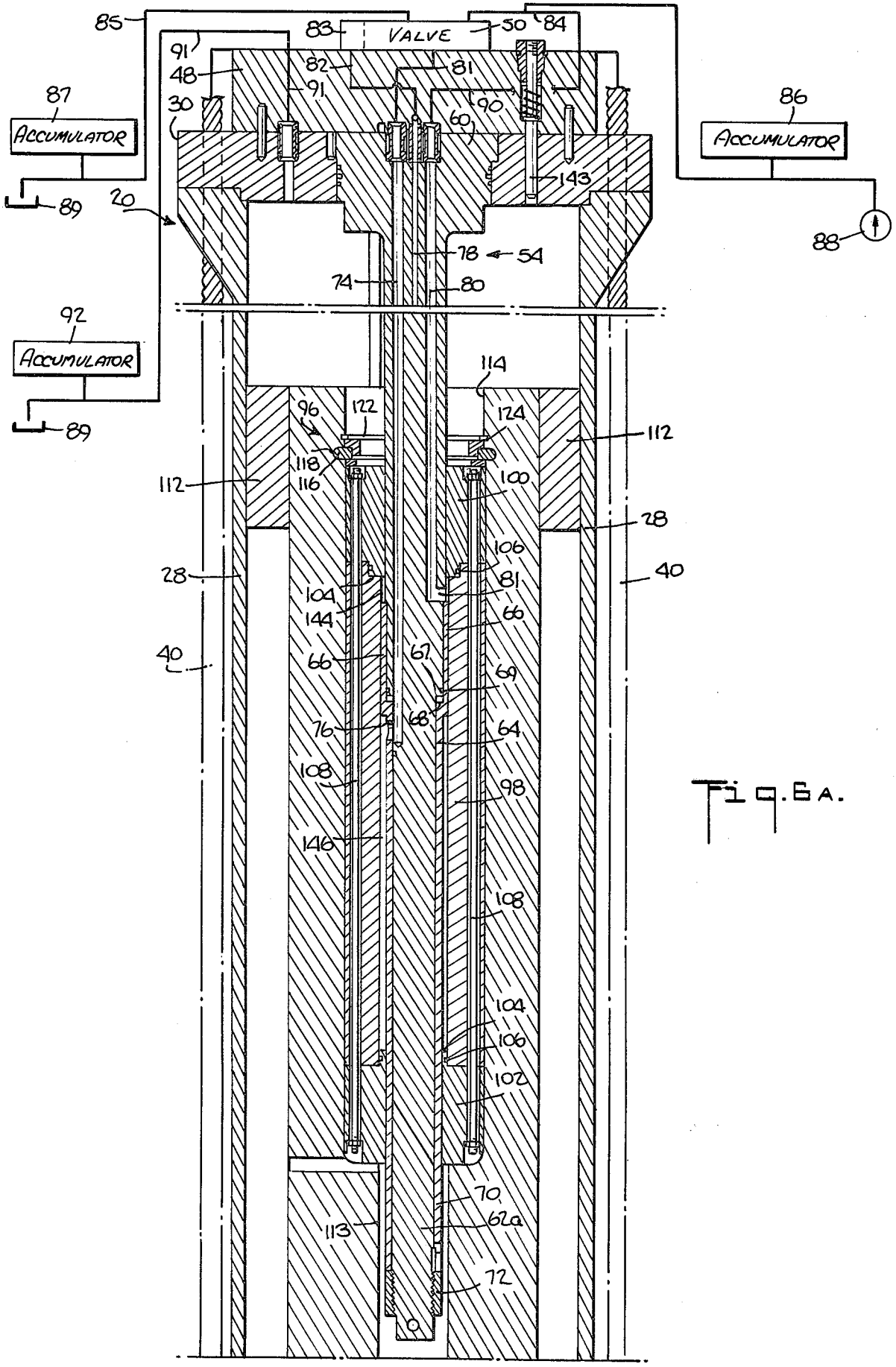
FIGS. 6A and 6B are views similar, respectively to FIGS. 5A and 5B for the hammer at another stage of its operating cycle.

The ram 110 is moved up and down by the hydraulic cylinder assembly 96 to which it is connected. This cylinder movement in turn is obtained through the control of fluid flow through the actuation and upper chamber supply conduits 74 and 80 in the piston rod assembly 54. As can be seen in FIGS. 5A and 6A, the large diameter cup shaped formation 66 of the piston rod assembly, which fits closely inside the tubular sleeve 98 of the cylinder assembly 96, divides the interior of the sleeve into upper and lower hydraulic chambers 144 and 146. Because the intermediate diameter upper portion 62 of the piston rod assembly is of large diameter than the elongated tubular small diameter section 68, the effective working of diametrical area of the lower hydraulic chamber 146 is greater than that of the upper hydraulic chamber 144. Thus when both chambers are subjected to the same high hydraulic pressure a greater total hydraulic force is produced in the lower chamber 146 and this forces the cylinder assembly 96 and the ram 110 downwardly. On the other hand when the upper chamber 144 is at high hydraulic pressure and the lower chamber 146 is switched to low or drain pressure the net hydraulic force on the cylinder assembly is upward and the cylinder assembly together with the ram 110 rises.

It will be seen from the foregoing that the hammer is operated by maintaining the upper hydraulic chamber 144 continuously at high pressure and by switching the lower hydraulic chamber 146 alternately between high and low pressure. The high pressure in the upper chamber is maintained by the connection from the high pressure accumulator 86 through the high pressure conduit 90 in the manifold 48 and the upper chamber supply conduits 80. The alternate switching of pressure in the lower chamber 146 is obtained by the valve assembly 50 which alternately connects its high and low pressure inputs 84 and 85 to the internal conduit 81 in the manifold 48 and to the actuation conduits 74 which communicate with the lower chamber 146 through the actuation ports 76.

Figure 6B:
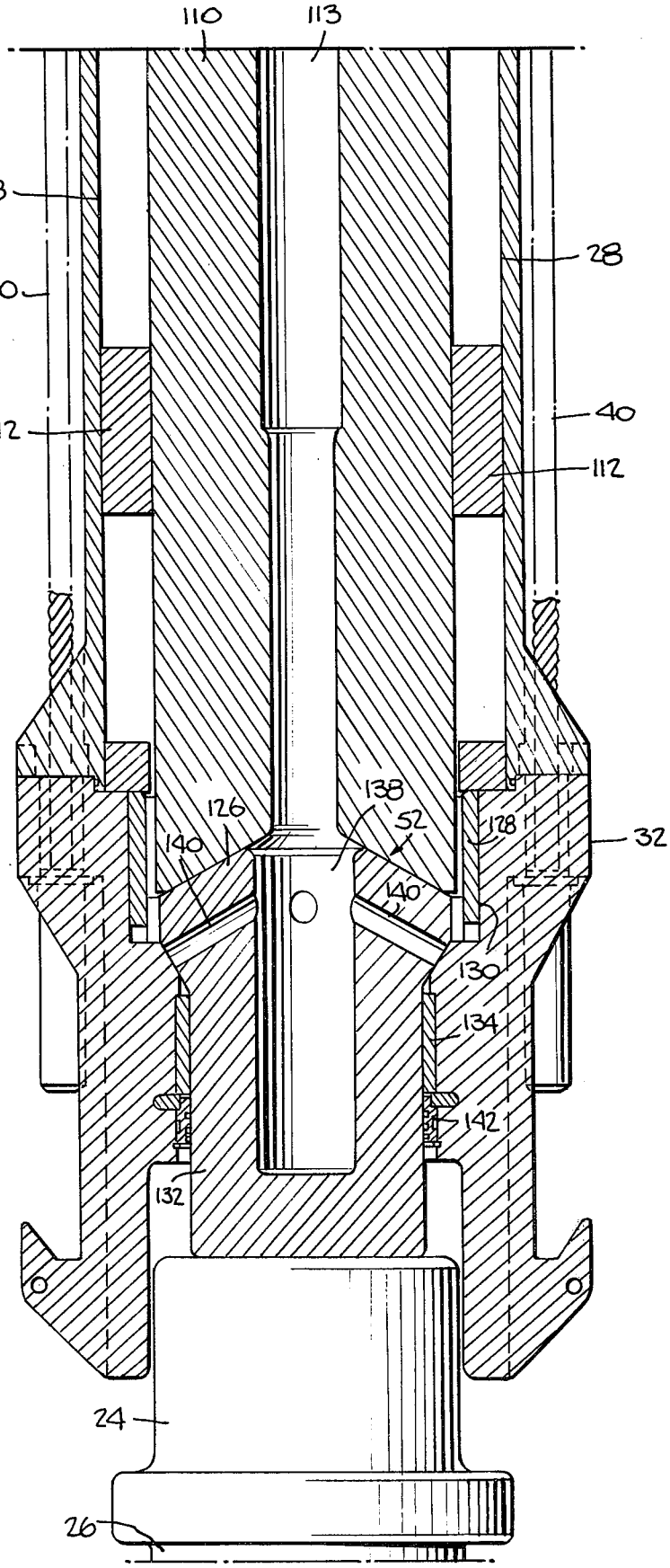

The switching of the valve assembly 50 is produced by its pilot section 83 which operates in response to sharply rising and falling pressure impulses produced in the pilot connection conduit 82 as the upper end collar 100 of the cylinder assembly 96 passes by the opening 79 of the pilot conduit 78. As can be seen in FIG. 5A, when the ram 110 is in its uppermost position, the pilot opening 79 is exposed below the bottom of the upper cylinder assembly 100 to the high pressure upper hydraulic chamber 144. This high pressure is applied to the pilot portion 83 of the valve assembly 50 causing it to place the high pressure input line 84 into communication with conduit 81 and the actuation conduits 74. This supplies high pressure fluid to the lower hydraulic chamber 146 and because the diametrical or workingg area of that chamber is greater than that of the upper chamber 144, the net hydraulic force on the cylinder assembly 96 is in a downward direction. Thus the cylinder assembly and the ram 110 to which it is attached move downwardly together until the ram impacts on the anvil 52 driving it and the capblock 24, as well as the pile 26 downwardly, as shown in FIG. 6B.

At about the time the ram 110 impacts the capblock 24, the pilot opening 79 becomes exposed, above the top of the upper cylinder assembly collar 100, to the low or drain pressure within the casing 28. This low pressure is applied through the pilot conduit 78 and pilot connection 82 to the pilot portion 83 of the valve assembly causing it to switch so as to place the low pressure input line 85 into communication with the conduit 81 and the actuation conduits 74. As a result, the lower hydraulic chamber 146 is switched to low hydraulic pressure and its hydraulic effect is overcome by the constant high hydraulic pressure in the upper chamber 144 so that the cylinder assembly 96 and the ram 110 are driven upwardly. The upper extent of ram movement can be detected by means of a top of stroke indicator gage 143 which extends through the casing top section 30 as shown in FIGS. 5A and 6A.

Figure 7:
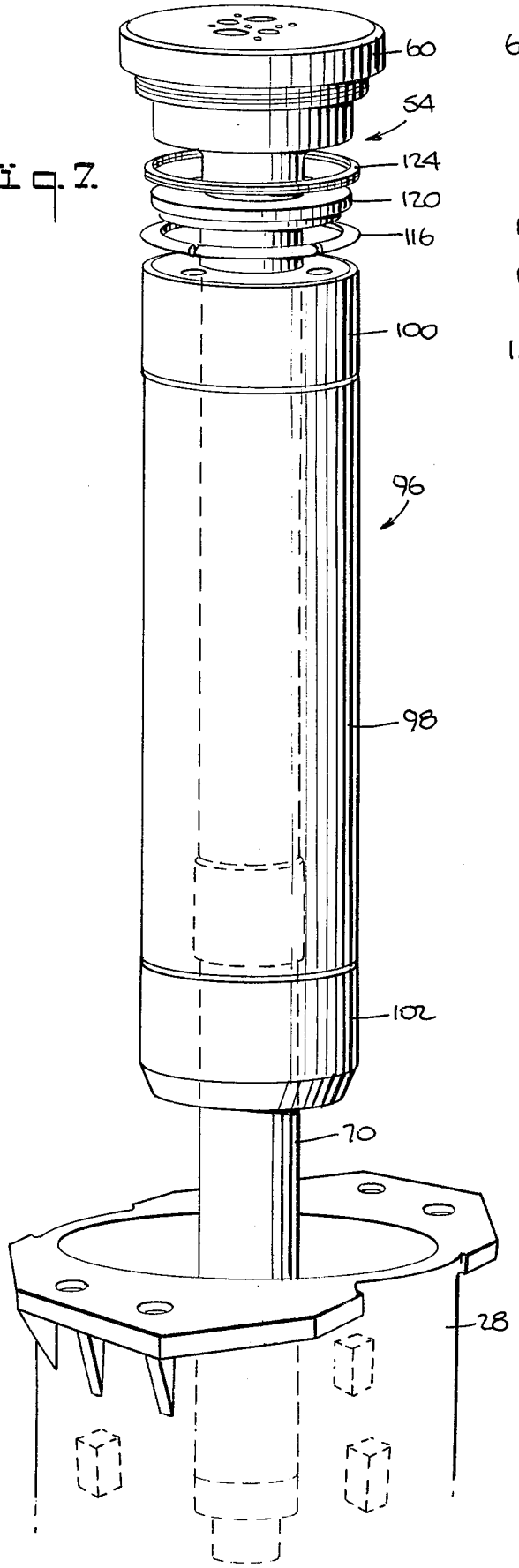
FIG. 7 is an exploded perspective view showing a cylinder and ram assembly for the hammer of FIG. 1.
Figure 8:
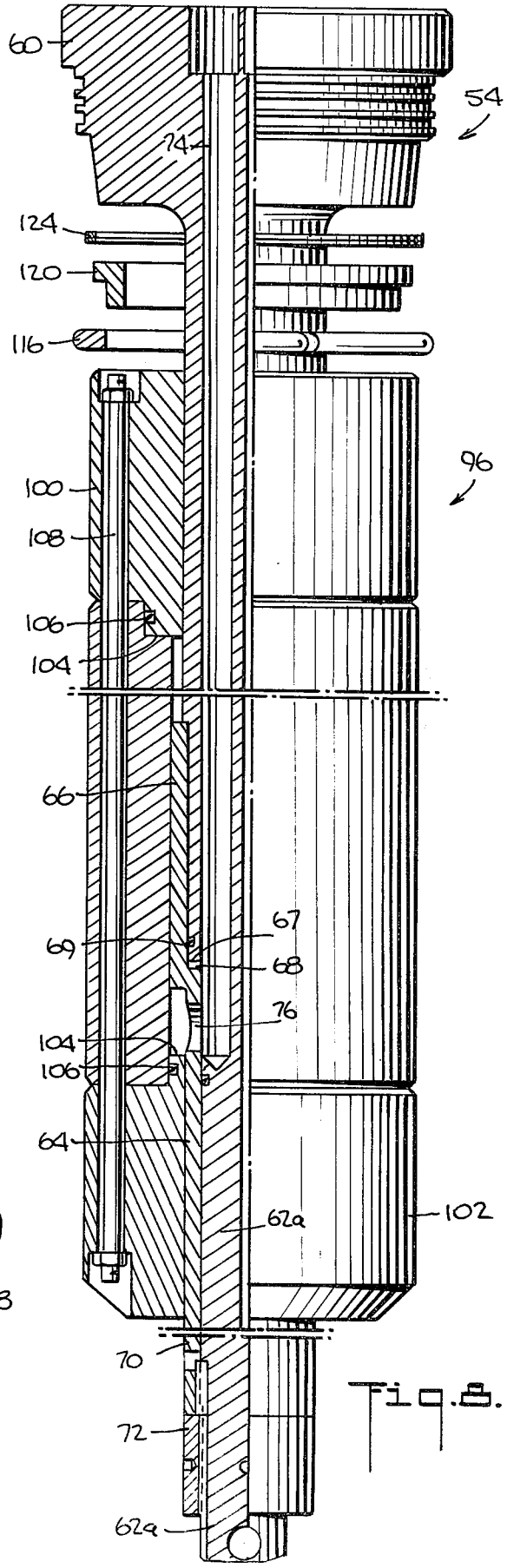
FIG. 8 is an enlarged elevational view, partially in section, showing a piston and cylinder assembly for the hammer of FIG. 1.
Figure 9:
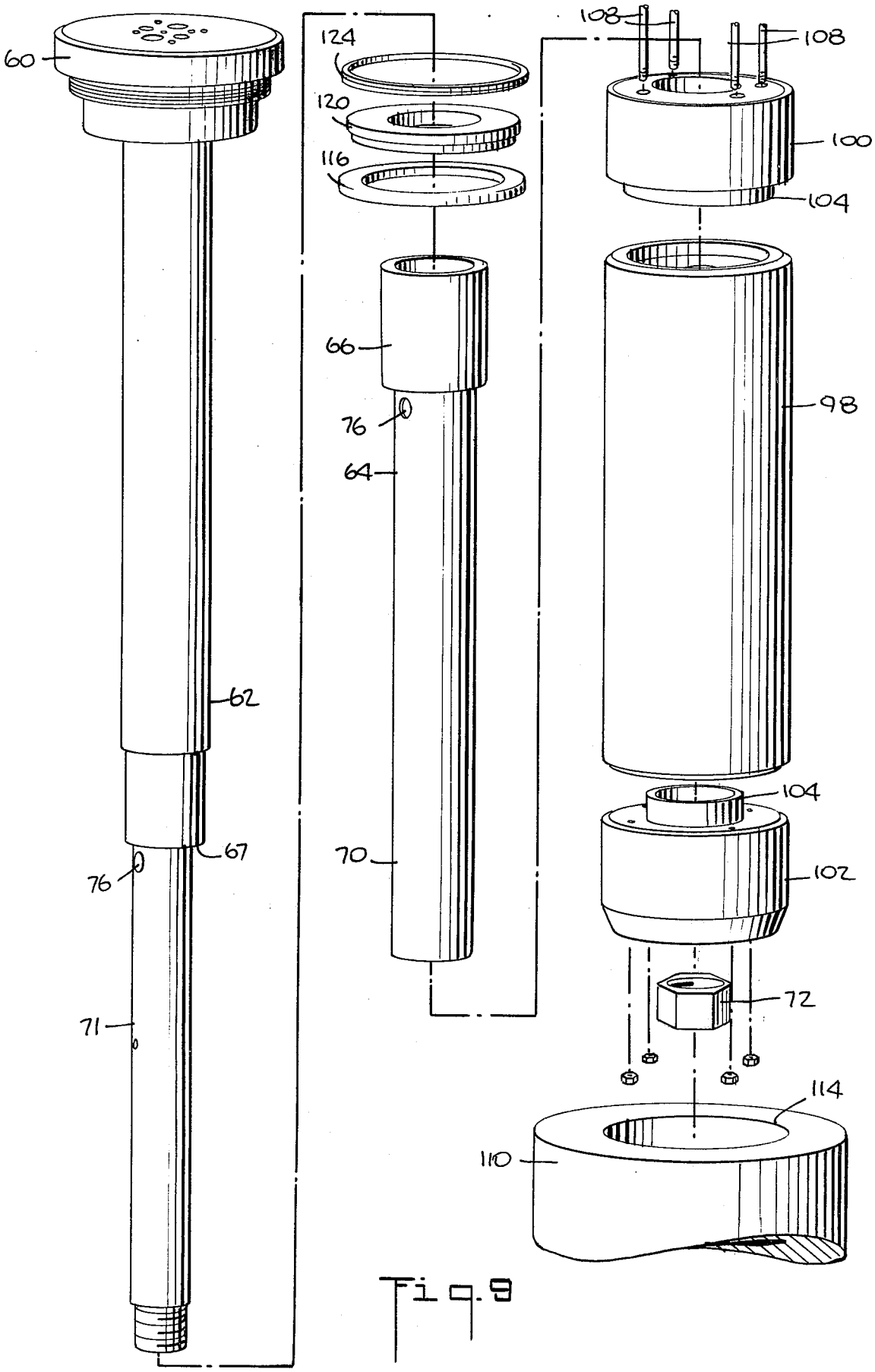
FIG. 9 is an exploded view showing the separted components of the piston and cylinder assembly of FIG. 8.

FIGS. 7–9 illustrate the manner in which the hammer assembly described above is assembled and FIGS. 10–13 illustrate the manner in which the assembled hammer assembly automatically adjusts and locks itself into position when subjected to operating hydraulic pressure.

As can be seen in FIGS. 7 and 8 the piston rod assembly 54 and the hydraulic cylinder assembly 96 may be pre-assembled as a sub-unit and this sub-unit can be inserted into the ram counterbore 114 either before or after the ram 110 is fitted into the casing 28. The segmented retention member 116 is then fitted into place and held there by the spreader ring 120. Thereafter the casing top section 30 (FIG. 5A) is secured to the top of the casing 28 and to the head portion 60 of the piston rod assembly.

Alternatively, as shown in FIG. 9 the tubular lower piston rod portion 64 of the piston rod assembly may be placed inside the tubular sleeve 98 of the hydraulic cylinder assembly and the upper and lower end collars 100 and 102 may be fitted into place. The tie rods 108 are then inserted to hold this partial assembly loosely together so that the overall hammer assembly can be completed. The thus partially assembled hydraulic piston and cylinder assembly is then inserted into the counterbore 114 in the tubular ram 110 and the segmented retention member 116 used to hold the partial assembly in place. The casing top section 30 is then mounted on the casing 28; and thereafter the upper part of the piston rod assembly, comprising the head portion 60, the intermediate diameter upper portion 62 and the small diameter lower extension 62*a*, all of which are integrally formed of one piece, is inserted down through the cylinder assembly. The lower end of the intermediate diameter upper portion 62 fits inside the cup shaped formation 66 while the small diameter lower extension 62*a*, passes down through the small diameter tubular section 70 until its threaded end projects beneath the tubular section 70. The retaining nut 72 is then filled up into the ram bore 113 and is turned onto the threaded end of the lower extension 62*a*, to hold the piston rod assembly together.

The diagrammatic representations of FIGS. 10–13 are useful in visualizing the advantages of the above described structural arrangements. Firstly it will be appreciated that by using a ram encased moveable hydraulic cylinder, very high hydraulic pressures may be employed with little or no tendency for the cylinder to bow outwardly under high hydraulic pressures. Secondly, by providing a differential area piston assembly which passes through both ends of the cylinder assembly a small differential area may be provided between the upper and lower hydraulic chambers 144 and 146 while at the same time the piston rod itself may be maintained at a diameter sufficient to ensure high strength and rigidity.

A third advantage obtained by the described construction is that the different elements of the piston rod assembly 54 and the hydraulic cylinder assembly 96 become self aligned when the system is subjected to operating hydraulic pressure. This is obtained because the upper and lower end collars 100 and 102, the tubular sleeve 98, the piston rod assembly 54 and the ram 110 are all dimensioned to provide a small amount of lateral movement with respect to each other. The flow of hydraulic fluid through the clearances between these members maintains them in proper alignment. Further, seals are not required along the relatively sliding surfaces because any leakage of hydraulic fluid simply passes into the interior of the outer casing 28. Actually a certain finite flow of fluid past the relatively sliding surfaces provides a cooling effect and reduces wear.

A fourth advantage obtained by the above described construction is that the operating hydraulic pressure serves to maintain the ram and cylinder assembly locked together as an integral unit. As can be seen in FIG. 10, when the unit is first assembled there exists a finite space $\alpha$ between the top of the upper end collar 100 and the bottom of the segmented retention member 116. When operating hydraulic pressure is applied to the upper chamber 144 the upper end collar 100 is forced to abut up against the retention member 116 to lock the cylinder assembly tightly to the ram. At this point the tie rods 108 perform no holding function. FIG. 13 shows the relative positions of the segmented member 116, the ram groove 118 and the spreader ring 120.

A still further advantage obtained by the described construction is that the piston rod assembly 54 is maintained under a constant stress with the elongated tubular small diameter section 70 pressing down continuously against the upper surface of the retaining nut 72 in the manner of a lock washer to prevent the nut from vibrating off during operation. This constant downward bias is maintained even though the lower hydraulic chamber 146 is alternately subjected to high and low pressure. As can be seen in FIG. 10 the upper hydraulic chamber 144 is maintained continuously at high hydraulic pressure to produce a constant downward force on the upper edge of the cup shaped formation 66 of the lower piston rod portion 64. The alternate high and low fluid pressure applied via the actuation conduits 74 to the lower hydraulic chamber 146 is also applied to the balancing chamber 68. In the lower chamber 146 this pressure acts upwardly on a lower annularly shaped diametrical area 148 (FIG. 11) on the lower piston rod portion 64 defined between the outer diameter of its cup shaped formation 66 and the diameter of its lower section 70. An upper annularly shaped diametrical area 150 of the lower piston rod portion 64 is defined between the inner diameter of the cup shaped formation 66 and the diameter of the lower extension 71 of the piston rod upper portion 62. The upper and lower diametrical areas 148 and 150, as shown in FIGS. 11 and 12, are dimensioned to be equal to each other so that any change in the common pressure applied to these areas is automatically compensated. Thus the hydraulic effect produced on the lower piston rod portion 64 by the changing pressure in the lower hydraulic chamber 146 is always balanced or nullified; and the net hydraulic force acting on the lower piston rod portion 64 is that produced by the continuous high pressure applied through the upper hydraulic chamber 144 to the upper edge of the large diameter cup shaped formation 66. It is this continuous hydraulic force that urges the tubular small diameter section 64 down against the retaining nut 72 to hold it tightly in place.

Having thus described the invention with particular reference to the preferred forms thereof, it will be obvious to those skilled in the art to which the invention pertains, after understanding the invention, that various changes and modifications may be made therein without departing from the spirit and scope of the invention as defined by the claims appended hereto.

What is claimed and desired to be secured by letters patent is:

1. A hydraulic hammer assembly comprising an outer casing, a central piston secured at one end to said casing, said piston having a large cross section region between regions of intermediate cross section and small cross section, a ram reciprocally moveable along said piston, said ram including a cylinder surrounding said piston and slideable therealong, said cylinder having a central internal region which closely accommodates said large cross section region of said piston and end regions which closely accommodate respectively, said regions of intermediate and small cross section of said piston said large cross section region of said piston thereby dividing said central internal region of said cylinder into two chambers of larger and smaller working area, respectively, an anvil mounted on said casing in the path of ram movement, hydraulic supply means including accumulator means for accommodating fluid flow while maintaining a substantially uniform high hydraulic pressure, said hydraulic supply means being in fluid communication with the chamber of small working area and hydraulic switching means being alternately connectable to said hydraulic supply means and to a drain, said hydraulic switching means being in fluid communication with the chamber of larger working area.

2. A hydraulic hammer assembly according to claim 1 wherein said casing is tubular and encloses said ram.

3. A hydraulic hammer assembly according to claim 2 wherein said casing is filled with hydraulic fluid.

4. A hydraulic hammer assembly according to claim 3 wherein said ram is guided in said casing by spaced apart bushings.

5. A hydraulic hammer assembly according to claim 1 wherein said hydraulic supply means comprises fluid conduits extending down through said piston.

6. A hydraulic hammer assembly according to claim 1 wherein said casing is tubular and is provided with top and bottom sections held to said casing by means of tension elements extending longitudinally of said casing.

7. A hydraulic hammer assembly according to claim 6 wherein said anvil includes a larger diameter head portion within said casing and a smaller diameter stem which projects out through an opening in said bottom section.

8. A hydraulic hammer assembly according to claim 7 wherein the upper end of said piston projects through said top section.

9. A hydraulic hammer assembly comprising an outer casing, a massive ram guided for reciprocal movement along said casing, an anvil positioned in said casing in the path of reciprocal ram movement to be hammered on by said ram, an actuating hydraulic piston and cylinder assembly including a piston rod extending out from a cylinder and secured to said casing, said cylinder fitting closely inside a cavity in said ram, said cylinder having elemental portions thereof which are moveable into tight contact with said ram upon application of high hydraulic pressure to the interior of said cylinder and hydraulic drive means connected to actuate said piston and cylinder assembly.

10. A hydraulic hammer assembly according to claim 9 wherein said cylinder is formed with a tubular central casing and at least one end member moveable longitudinally a finite amount with respect to the other end member in response to hydraulic pressure within said central casing.

11. A hydraulic hammer assembly according to claim 10 wherein said ram is formed with abutment elements which project into the path of finite longitudinal movement of said end member.

12. A hydraulic hammer assembly according to claim 11 wherein said abutment elements comprise abutment ring segments which fit into a circumferential groove formed about said cavity just above one of said end members.

13. A hydraulic hammer assembly according to claim 12 wherein a spreader ring is fitted within the inner circumference of said abutment ring segments to maintain them spaced apart and into said circumferential groove.

14. A hydraulic hammer assembly according to claim 13 wherein a snap ring fits into a snap ring groove in said cavity to hold said spreader in place.

15. A hydraulic hammer assembly according to claim 10 wherein said cylinder is formed with a tubular central casing and end members and wherein tie rods extend longitudinally of the cylinder to hold the central casing and end members loosely together for assembly.

16. A hydraulic hammer assembly according to claim 15 wherein said end members have extensions which fit inside the ends of said central casing.

17. A hydraulic hammer assembly according to claim 16 wherein O-ring seals are provided between said extensions and said central casing.

18. A hydraulic hammer assembly comprising an outer casing, a massive ram guided for reciprocal movement along said casing, an anvil positioned in said casing in the path of said ram to be hammered on by the lower end of the ram, said ram being formed with a longitudinal bore opening out onto its upper end, a hydraulic piston and cylinder assembly including a piston rod extending out from a cylinder, means securing said piston rod to said casing near its upper end, said piston and cylinder assembly being fitted into the longitudinal bore of said ram with said cylinder locked to said ram and hydraulic drive means to actuate said piston and cylinder assembly, said drive means having hydraulic conduits extending through said piston rod.

19. A hydraulic hammer assembly according to claim 18 wherein said cylinder has an outer diameter which is closely accommodated by the longitudinal bore of said ram.

20. A hydraulic hammer assembly according to claim 19 wherein the longitudinal bore of said ram is longer than the length of said cylinder and wherein removeable abutment means are provided in said bore just above said cylinder to maintain it in place.

21. A hydraulic hammer assembly according to claim 20 wherein said removeable abutment means comprises abutment ring segments which fit into a circumferential groove formed about said bore, said segments extending out into said bore.

22. A hydraulic hammer assembly according to claim 21 wherein said removeable abutment means further includes a spreader ring which fits within the inner circumference of the abutment ring segments to maintain them spread apart and into said circumferential groove.

23. A hydraulic hammer assembly according to claim 22 wherein said piston and cylinder assembly is self contained upon removal from said ram.

24. A hydraulic hammer assembly according to claim 18 wherein said piston and cylinder assembly is formed with an enlarged head on a piston rod extending out from said assembly, said head being connected to the upper end of said casing.

25. A hydraulic hammer assembly according to claim 24 wherein said casing is tubular and encloses said ram.

26. A hydraulic hammer assembly according to claim 25 wherein said casing includes a top section secured to an enlarged head formed on one end of a piston rod portion of said piston and cylinder assembly.

27. A hydraulic hammer assembly comprising an outer casing, a massive ram guided for reciprocal movement along said casing, an anvil positioned in said casing in the path of reciprocal ram movement to be hammered on by said ram, said ram being formed with a longitudinal bore opening out onto its upper end, a hydraulic piston and cylinder assembly comprising a central tubular cylinder member and upper and lower cylinder end members fitted into the ends of said tubular cylinder member, said end members being formed with central openings of different size, a piston rod comprising an elongated member attached at one end to said casing and extending down therefrom into said tubular cylinder member, said piston rod having a large diameter section which fits closely in but slides along the inner surface of said tubular cylinder member, said piston rod having upper and lower sections which fit closely into and slide along the different central openings, respectively, of said end members, said piston rod, said end members, said tubular cylinder member and said ram being relatively moveable a finite amount in the lateral direction so that upon subjecting said piston and cylinder assembly to high hydraulic pressure said members and said ram become automatically aligned.

28. A hydraulic hammer assembly according to claim 27 wherein said piston rod is formed of two elements which comprise said upper section and lower section respectively, one of said elements having a large diameter cup shaped portion which telescopes over the other element.

29. A hydraulic hammer assembly according to claim 28 wherein an O-ring seal is provided between said elements at said cup shaped portion.

30. A hydraulic hammer assembly according to claim 27 wherein said cylinder end members are formed with extensions which fit inside the ends of said central tubular cylinder member.

31. A hydraulic hammer assembly according to claim 30 wherein O-ring seals are provided between said extensions and said central tubular cylinder member.

* * * * *

UNITED STATES PATENT OFFICE

CERTIFICATE OF CORRECTION

Patent No. 3,939,922 Dated February 24, 1976

Inventor(s) WILLIAM J. SWENSON

It is certified that error appears in the above-identified patent and that said Letters Patent are hereby corrected as shown below:

Column 4, line 31, after "tubular" insert --lower--;

Column 4, line 38, change "as" to --at--;

Column 6, line 68, change "workingg" to --working--;

Signed and Sealed this

*first* Day of *June 1976*

[SEAL]

*Attest:*

RUTH C. MASON
*Attesting Officer*

C. MARSHALL DANN
*Commissioner of Patents and Trademarks*